US006676480B2

(12) United States Patent
Sheltman

(10) Patent No.: US 6,676,480 B2
(45) Date of Patent: Jan. 13, 2004

(54) STAGING MECHANISM FOR TOY VEHICLE PLAYSET

(75) Inventor: David A. Sheltman, Long Beach, CA (US)

(73) Assignee: Mattel, Inc., El Segundo, CA (US)

( * ) Notice: Subject to any disclaimer, the term of this patent is extended or adjusted under 35 U.S.C. 154(b) by 46 days.

(21) Appl. No.: 10/159,609

(22) Filed: May 31, 2002

(65) Prior Publication Data

US 2003/0224696 A1 Dec. 4, 2003

(51) Int. Cl.[7] ..... A63H 29/00
(52) U.S. Cl. ..... 446/429; 446/444; 446/431
(58) Field of Search ..... 446/431, 435, 446/441, 442, 443–447, 457, 465, 429, 430, 470, 471

(56) References Cited

U.S. PATENT DOCUMENTS 2,106,698 A * 2/1938 Bonanno ..... 105/1.5
2,994,159 A * 8/1961 Bonidie ..... 446/435
3,600,849 A * 8/1971 Faller ..... 446/429
4,267,661 A 5/1981 Hanson
4,291,878 A 9/1981 Nagel et al.
4,312,149 A 1/1982 Iwao
4,397,465 A 8/1983 Gable
4,403,440 A 9/1983 Wulff
4,433,504 A * 2/1984 Terui ..... 446/75
4,472,905 A 9/1984 Silverman et al.
4,475,303 A 10/1984 Ribas et al.
4,642,066 A 2/1987 Kennedy et al.
5,254,030 A 10/1993 Ostendorff et al.
5,370,571 A 12/1994 Bosch
5,643,040 A 7/1997 Hippely et al.
5,767,655 A 6/1998 Ostendorff et al.
5,871,385 A * 2/1999 Hippely et al. ..... 446/424
6,000,992 A 12/1999 Lambert

* cited by examiner

*Primary Examiner*—Jacob K. Ackun
*Assistant Examiner*—Bena B. Miller
(74) *Attorney, Agent, or Firm*—Roy A. Ekstrand

(57) ABSTRACT

A continuous loop toy vehicle trackset supports a booster and a plurality of toy vehicles. The trackset is formed of spaced apart track rails forming a gap therebetween. The toy vehicles are open wheeled and able to roll upon the track rails in either a right side up or inverted configuration. In the inverted configuration, the top surface of the toy vehicle is able to extend into the gap between the track rails. A staging lane facilitates introduction of additional toy vehicles to the trackset.

1 Claim, 5 Drawing Sheets

STAGING MECHANISM FOR TOY VEHICLE PLAYSET

CROSS-REFERENCE TO RELATED PATENT APPLICATIONS

This application discloses apparatus described and claimed in a co-pending application entitled Inverting Toy Vehicle Playset which is hereby incorporated herein by reference and which is assigned to the assignee of the present application.

FIELD OF THE INVENTION

This invention relates generally to toy vehicle playsets and particularly to those utilizing closed trackways having toy vehicle boosters operated therein to propel free wheeling toy vehicles about various loops and curves in the trackway in a continuous travel.

BACKGROUND OF THE INVENTION

Toy vehicle playsets are well known in the art and have enjoyed great popularity for many years. Not surprisingly, practitioners in art have provided a virtually endless variety of toy vehicle playsets having various types of tracks and trackways and various types of toy vehicles operative thereon.

Perhaps one of the most common and popular types of toy vehicle playsets utilizes a closed loop track defining a plurality of curves and loop portions within which one or more toy vehicle boosters are operated. A typical toy vehicle booster utilizes one or more rotating wheels which engage the sides or top portions of the toy vehicle entering the booster and due to their motor-driven rotation accelerate the toy vehicle through the playset trackway. To improve the amusement, excitement and appeal of toy vehicle playsets, practitioners of the toy arts have endeavored to provide various stunt apparatus within playsets. Examples of such stunt apparatus include inverting loops, spiral paths, jumps of various kinds as well as obstacles or interfering elements which attach or impede passing toy vehicles.

The toy vehicles themselves are generally free wheeling in such booster activated playsets and comprise relatively simple toy vehicle bodies having a plurality of supporting freely rolling wheels.

Despite substantial variation and great effort by practitioners of the toy arts in providing evermore improved and interesting toy vehicle playsets, there remains nonetheless a continuing need in the art for ever more interesting, exciting and innovative toy vehicle playsets.

SUMMARY OF THE INVENTION

Accordingly, it is a general object of the present invention to provide an improved toy vehicle playset. It is a more particular object of the present invention to provide an improved toy vehicle playset having additional exciting play features not found in the present art.

In accordance with the present invention there is provided a toy vehicle playset comprising: a toy vehicle; a toy vehicle track; and a staging mechanism having a carriage defining a throughway ramp and a staging ramp, the carriage being movable between a staged position aligning the throughway ramp with the toy vehicle track and holding the toy vehicle on the staging lane and a launch position aligning the staging ramp with the toy vehicle track allowing the toy vehicle to leave the staging ramp.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
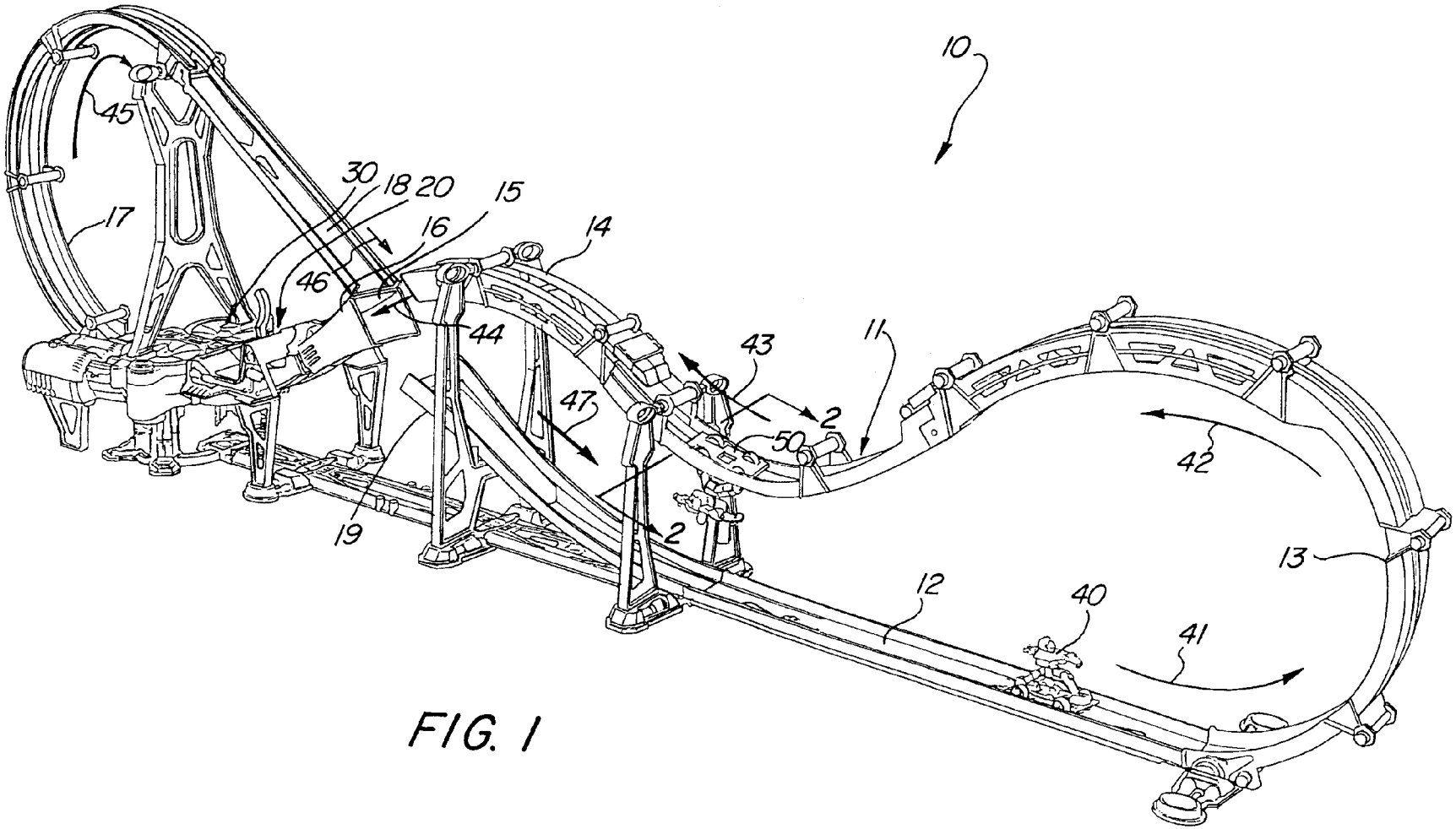
FIG. 1 sets forth a perspective view of an inverting toy vehicle playset constructed in accordance with the present invention and having a plurality of toy vehicles operative thereon.

FIG. 1 sets forth a perspective view of an inverting toy vehicle playset constructed in accordance with the present invention and generally referenced by numeral 10. Playset 10 includes a closed loop trackset 11 fabricated in the manner set forth below in greater detail. Suffice it to note here that trackset 11 includes a straight portion 12 coupled to a reversing loop 13 which in turn is coupled to a multiply curved ramp 14. A toy vehicle scoop 16 is supported in a spaced relationship from curved ramp 14 to form a gap 15 therebetween. Scoop 16 is coupled to a staging lane mechanism 20 described below in greater detail. Suffice it to note here that staging lane mechanism 20 includes a through lane coupled to scoop 16 which in turn is coupled to a battery powered booster stage 30. Booster stage 30 is constructed in accordance with conventional fabrication techniques and includes one or more rotating elastic wheels which engage toy vehicles passing into booster stage 30 and accelerate the toy vehicles. A reversing loop 17 is coupled to the output of booster stage 30 which in turn is coupled to a downwardly angled slide 18. Slide 18 terminates at gap 15 and is thus spaced from a downwardly angled curved ramp 19. The latter is coupled to straight portion 12 completing the circuit of trackset 11.

In accordance with the present invention, a plurality of toy vehicles such as toy vehicle 40 and toy vehicle 50 are able to simultaneously traverse trackset 11. The travel path for toy vehicles 40 and 50 may be illustrated considering toy vehicle 40. Toy vehicle 40 is moving upon straight portion 12 in the direction indicated by arrow 41. Thereafter, toy vehicle 40 is reversed in the direction indicated by arrow 42 by loop 13 and travels through curved ramp 14 in the direction indicated by arrow 43. At the end of ramp 14, toy vehicle 40 is carried by its momentum across gap 15 in the direction indicated by arrow 44 to be caught by scoop 16. Scoop 16 guides toy vehicle 40 through the through lane of staging lane mechanism 20 into booster stage 30. Thereafter, toy vehicle 40 is accelerated by booster stage 30 into loop 17 and reversed in the direction indicated by arrow 45. Toy vehicle 40 then moves downwardly on slide 18 in the direction indicated by arrow 46 jumping gap 15 and thereafter landing on ramp 19. Finally, toy vehicle 40 travels down ramp 19 in the direction indicated by arrow 47 and is guided to straight portion 12 completing a circuit.

In accordance with an important aspect of the present invention set forth below in FIGS. 2 and 3, it will be noted that toy vehicle 40 and toy vehicle 50 are oppositely oriented as they traverse different positions of trackset 11. This is accomplished by providing the combination of the structure of trackset 11 and the open wheel construction of toy vehicles 40 and 50. The ability of toy vehicles 40 and 50 to travel upon trackset 11 in either a right side up or upside down configuration is illustrated in FIGS. 2 and 3 below.

Figure 2:
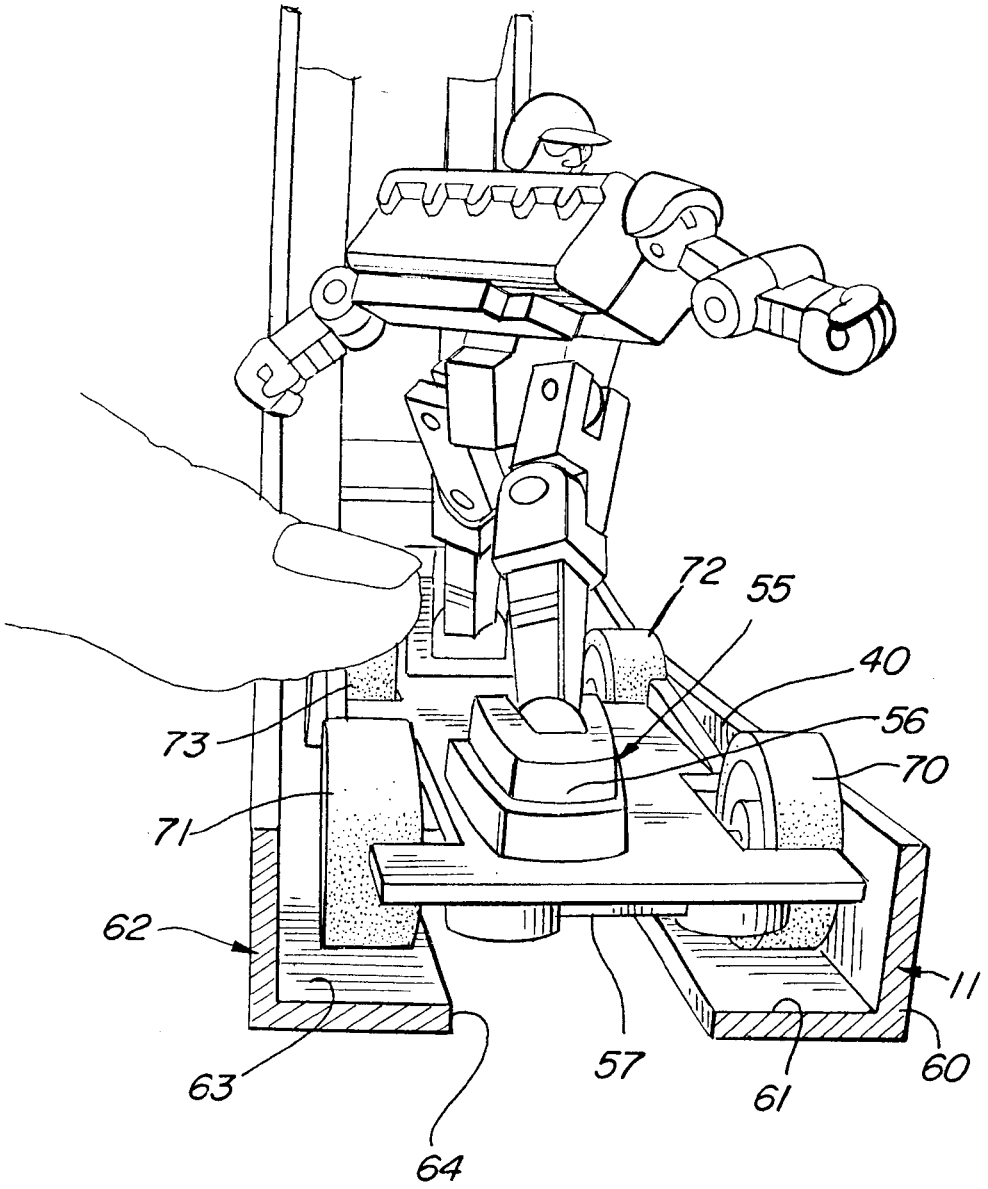
FIG. 2 sets forth a section view of the trackset of FIG. 1 taken along section lines 2—2 therein having an illustrative toy vehicle in its rightside up configuration.
Figure 3:
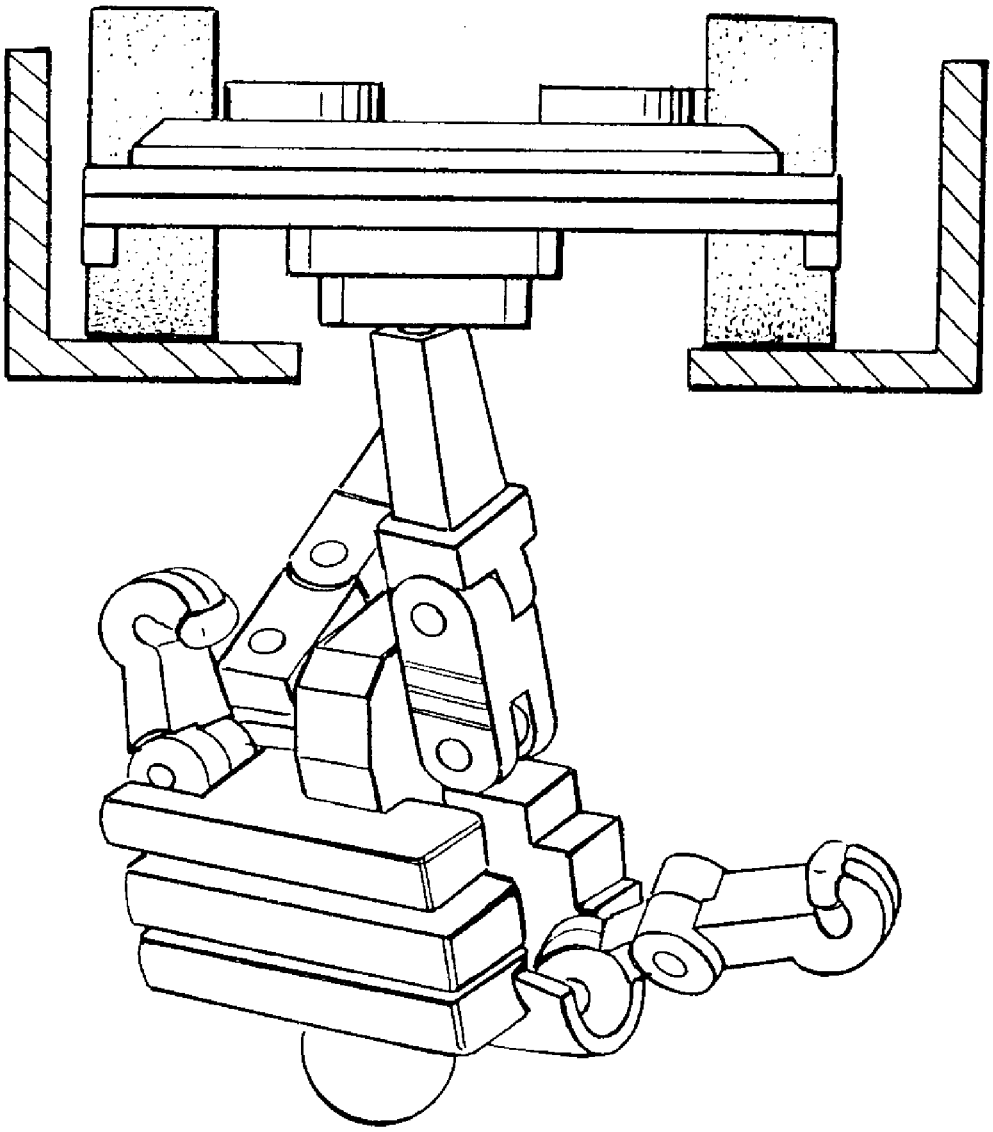
FIG. 3 sets forth the section view of FIG. 2 having an illustrative toy vehicle in its upside down configuration.

FIGS. 2 and 3 set forth identical section views of a portion of trackset 11 taken along section lines 2—2 in FIG. 1. In FIG. 2, toy vehicle 40 is shown in its right side up configuration as it traverses a section of trackset 11 while in FIG. 3, toy vehicle 40 is shown upside down traversing the same track portion.

More specifically, trackset 11 includes a pair of parallel track rails 60 and 62 each having upper surfaces 61 and 63 respectively. Trackset 11 further includes a gap 64 formed between track rails 60 and 62.

A toy vehicle 40 includes a body 55 defining a top surface 56 and a bottom surface 57. Toy vehicle 40 further includes a pair of front wheels 70 and 71 and a pair of rear wheels 72 and 73. Wheels 70 through 73 are freely rolling wheels and are preferably powered wheels. In addition, the configuration of top surface 56 and bottom surface 57 of body 55 provide an open wheel exposure of both the upper portions and lower portions of wheels 70 through 73. In this manner, toy vehicle 40 is able to travel upon trackset 11 in the right side configuration shown in FIG. 2 or the inverted configuration shown in FIG. 3.

Thus, in the right side upon configuration of toy vehicle 40 shown in FIG. 2, it will be noted that the bottom portions of wheels 70 through 73 roll upon surfaces 61 and 63 supporting toy vehicle 40 upon surfaces 61 and 63 in a right side up configuration.

Figure sets forth the section view of FIG. 2 having toy vehicle 40 riding upon trackset 11 in its inverted configuration. The important aspect with respect to the present invention, is found in the ability of gap 64 between track rails 60 and 62 to accommodate upward extension of the top portion of toy vehicle 40 when in its in inverted configuration.

More specifically, trackset 11 includes a pair of parallel track rails 60 and 62 each having upper surfaces 61 and 63 respectively. Trackset 11 further includes a gap 64 formed between track rails 60 and 62.

A toy vehicle 40 includes a body 55 defining a top surface 56 and a bottom surface 57. Toy vehicle 40 further includes a pair of front wheels 70 and 71 and a pair of rear wheels 72 and 73. Wheels 70 through 73 are freely rolling wheels and are preferably powered wheels. In addition, the configuration of top surface 56 and bottom surface 57 of body 55 provide an open wheel exposure of both the upper portions and lower portions of wheels 70 through 73. In this manner, toy vehicle 40 is able to travel upon trackset 11 in the right side configuration shown in FIG. 2 or the inverted configuration shown in FIG. 3.

Thus, it will be seen that gap 64 readily accommodates the downward extension of toy surface 56 of toy vehicle body 55 when toy vehicle 40 is inverted. It will be noted that in both configurations, right side up and upside down toy vehicle wheels 70 through 73 ride upon surfaces 61 and 63 of track rails 60 and 62 respectively.

Figure 4:
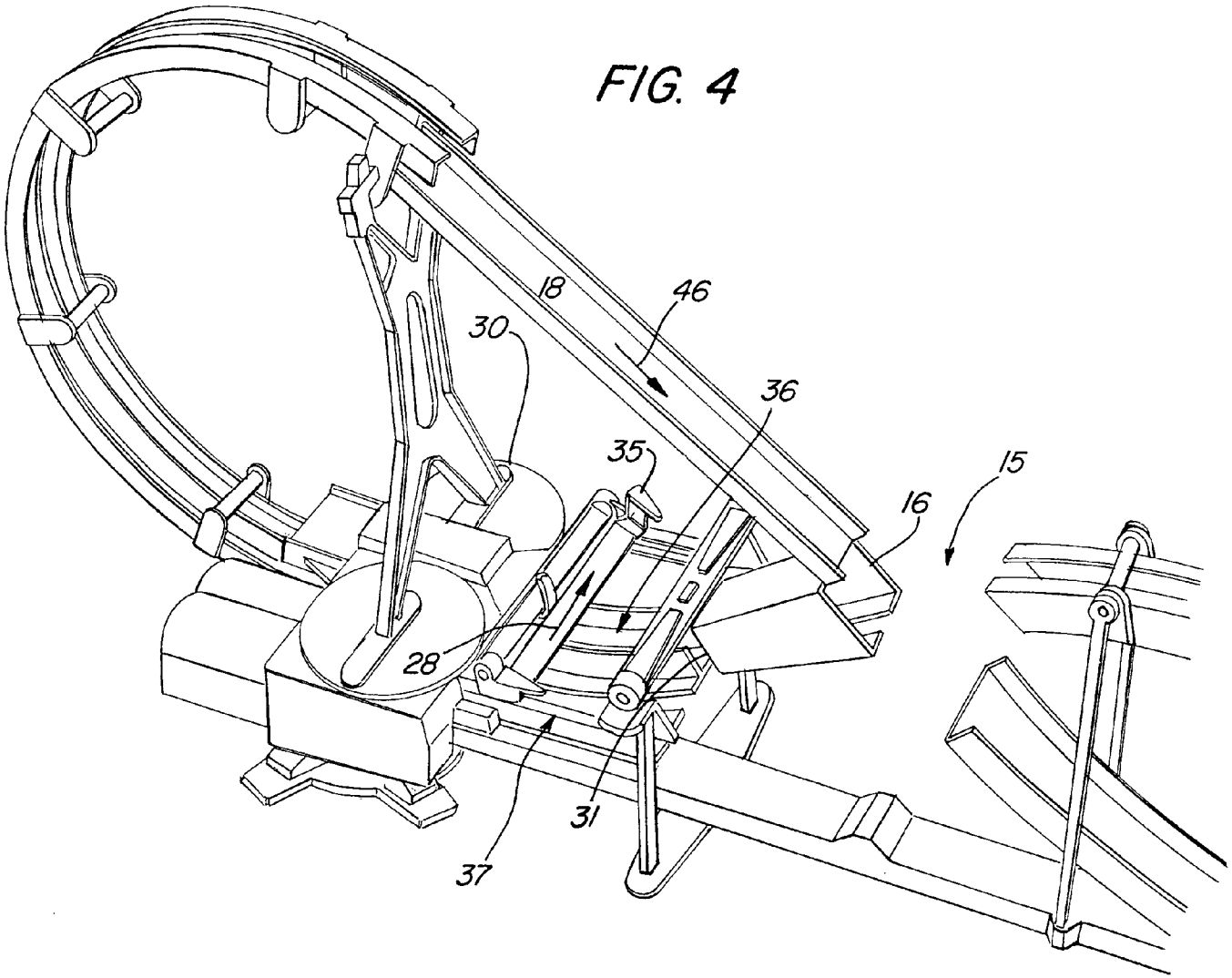
FIG. 4 sets forth an enlarged partial perspective view of the staging lane portion of the present invention inverting toy vehicle playset.
Figure 5:
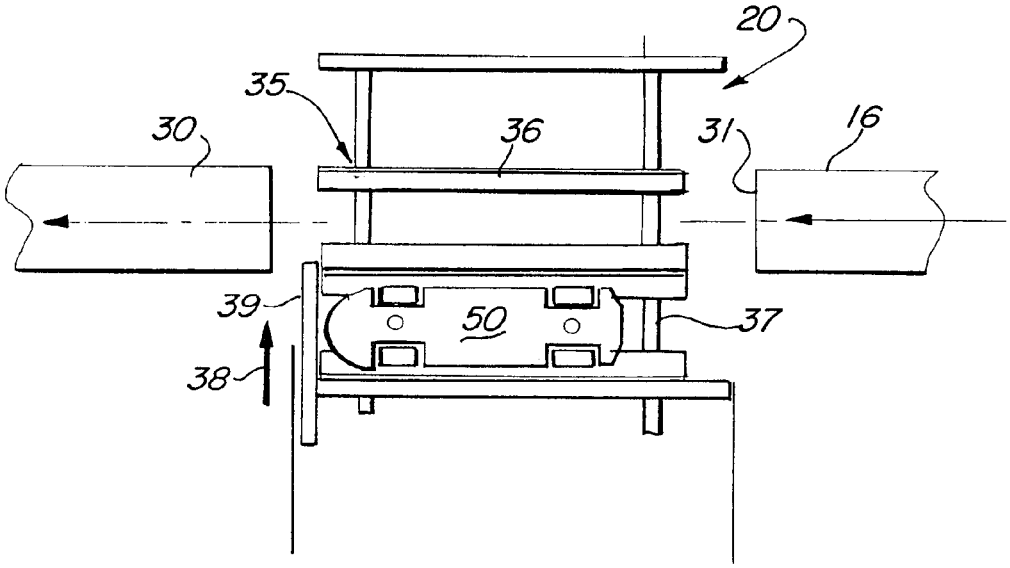
FIG. 5 sets forth a simplified top view of the staging apparatus of the present invention inverting toy vehicle playset showing a toy vehicle staged for entrance to the trackway.

FIG. 4 sets forth an enlarged perspective view of the staging lane and booster apparatus of the present invention inverting toy vehicle playset. As described above, trackset 11 includes a scoop 16 receiving a toy vehicle traversing gap 15 formed in trackset 11. Scoop 16 is downwardly angled and is tapered toward an exit opening 31. Staging lane mechanism 20 is supported in close proximity to exit opening 31 and includes a sliding carriage 35 which in turn supports a through way lane 36 and a staging lane 37. Carriage 35 is shown in the staged position in which through way lane 36 is aligned with exit opening 31. In this stage position, a second toy vehicle may be supported upon staging lane 37 as shown in FIG. 5 below. Through way lane 36 is coupled to booster 30 which in turn is coupled to trackset 11.

Thus, with a toy vehicle supported within staging lane 37, and with through way ramp 36 aligned with exit opening 31 of scoop 16, toy vehicles are able to pass from gap 15 through scoop 16 and through way ramp 36 into booster 30 and continue through trackset 1. When the user desires to introduce the staged vehicle in staging lane 37, the user simply slides carriage 35 in the direction indicated by arrow 38 moving ramp 36 away from exit opening 31 and aligning staging lane 37 with booster 30. Once lane 37 has moved into a alignment with booster 30, the incline of staging lane 37 allows the staged toy vehicle to move downwardly into booster stage 30 and to be accelerated therethrough. In this manner, a succession of toy vehicles may be staged and at the desired time introduced to the flow of toy vehicles.

FIG. 5 sets forth a simplified top view of staging lane mechanism 20 showing a vehicle in the staged position. Staging lane mechanism 20 includes a movable carriage 35 having a though way ramp 36 and a staging lane 37 supported thereon. A staging wall 39 extends across staging lane 37 to retain a toy vehicle 50 positioned upon staging lane 37. Through way ramp 36 is aligned with exit opening 31 of scoop 16 and booster stage 30. Thus, toy vehicles are able to pass through staging lane mechanism 20 using ramp 36 to pass from exit opening 31 of scoop 16 into booster stage 30 so long as carriage 35 remains in its staged position. Wall 39 retains toy vehicle 50 and the apparatus is stable.

When the user desires to introduce toy vehicle 50 into the trackset, the user simply slides carriage 35 in the direction indicated by arrow 38 to align staging lane 37 and vehicle 50 with booster stage 30.

Figure 6:
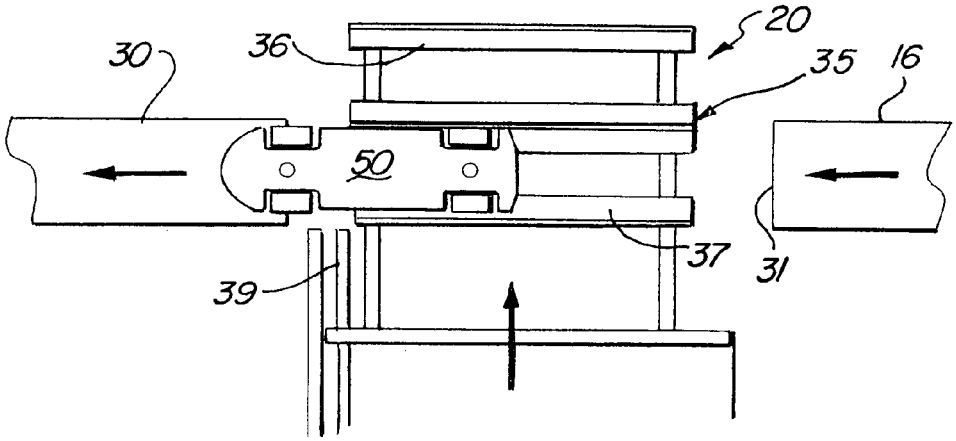
FIG. 6 shows a simplified top view of the staging portion of the present invention inverting toy vehicle playset inserting a staged toy vehicle into the toy vehicle trackway.

FIG. 6 sets forth the configuration of staging lane mechanism 20 as staged toy vehicle 50 is aligned with booster 30 and introduced into the trackset. It will be noted that in the position shown in FIG. 6, the movement of carriage 35 aligning staging lane 37 with booster 30 also moves toy vehicle 50 past staging wall 39. This releases toy vehicle 50 and allows it to travel to booster 30.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle playset comprising:

a toy vehicle;

a toy vehicle track; and a staging mechanism having a carriage defining a throughway ramp and a staging ramp, said carriage being movable between a staged position aligning said throughway ramp with said toy vehicle track and holding said toy vehicle on said staging ramp and a launch position aligning said staging ramp with said toy vehicle track allowing said toy vehicle to leave said staging ramp.

* * * * *